US011240616B2

(12) United States Patent
Boretzki et al.

(10) Patent No.: US 11,240,616 B2
(45) Date of Patent: Feb. 1, 2022

(54) METHOD AND SYSTEM FOR ADJUSTING A HEARING DEVICE TO PERSONAL PREFERENCES AND NEEDS OF A USER

(71) Applicant: SONOVA AG, Staefa (CH)

(72) Inventors: Michael Boretzki, Ruti (CH); Maxi Susanne Moritz, Stafa (CH); Elmar Fichtl, Hombrechtikon (CH); Volker Kuehnel, Mannedorf (CH); Ullrich Sigwanz, Hombrechtikon (CH); Josef Chalupper, Paunzhausen (DE)

(73) Assignee: Sonova AG, Staefa (CH)

( * ) Notice: Subject to any disclaimer, the term of this patent is extended or adjusted under 35 U.S.C. 154(b) by 0 days.

(21) Appl. No.: 16/767,076

(22) PCT Filed: Nov. 28, 2017

(86) PCT No.: PCT/EP2017/080575

§ 371 (c)(1),
(2) Date: May 26, 2020

(87) PCT Pub. No.: WO2019/105520

PCT Pub. Date: Jun. 6, 2019

(65) Prior Publication Data

US 2020/0322742 A1 Oct. 8, 2020

(51) Int. Cl.
*H04R 25/00* (2006.01)

(52) U.S. Cl.
CPC ..... *H04R 25/70* (2013.01); *H04R 25/558* (2013.01); *H04R 2225/61* (2013.01)

(58) Field of Classification Search
CPC ... H04R 25/70; H04R 25/558; H04R 2225/61
(Continued)

(56) References Cited

U.S. PATENT DOCUMENTS 8,787,603 B2 * 7/2014 Fichtl ..... H04R 25/50 381/314

FOREIGN PATENT DOCUMENTS

DE 19542961 5/1997
WO 2003030586 4/2003
(Continued)

OTHER PUBLICATIONS

Wikipedia: Linear Interpolation, Jul. 22, 2017, XP055481341,Retrieved from the internet: URL:http://en.wikipedia.org/w/index.php?title=Linear_interpolation$oldid=801834460. Paragraph Linear interpolation between two known points.

(Continued)

*Primary Examiner* — Sean H Nguyen
(74) *Attorney, Agent, or Firm* — ALG Intellectual Property, LLC

(57) ABSTRACT

The present invention pertains to a method for adjusting a hearing device to personal preferences and needs of a user. The proposed method comprises providing initial settings and target settings for signal processing parameters of the hearing device, the user operating the user control element to provide an input for adjusting the current settings so as to meet the personal preferences and needs of the user, adjusting the current settings based on the initial settings and the target settings in dependence of the input to provide adjusted settings for the signal processing parameters. Thereby the user control element is located at the hearing device and/or a hearing device accessory such as a smartphone or tablet. Moreover, the present invention provides a system structured and configured to carry out the proposed method.

18 Claims, 3 Drawing Sheets

(58) Field of Classification Search
USPC ..... 381/315
See application file for complete search history.

(56) References Cited

FOREIGN PATENT DOCUMENTS

| | | |
|---|---|---|
| WO | 2016024978 | 2/2016 |
| WO | 2017182078 | 10/2017 |

OTHER PUBLICATIONS

International Search Report and Written Opinion received in International Application No. PCT/EP2017/080575.

* cited by examiner

Trade-off hearing comfort vs. clarity win @ start of acclimatization ($t = t_0$)

Trade-off hearing comfort vs. clarity win @ end of acclimatization ($t = t_E$)

METHOD AND SYSTEM FOR ADJUSTING A HEARING DEVICE TO PERSONAL PREFERENCES AND NEEDS OF A USER

TECHNICAL FIELD

The present invention pertains to a method and system for adjusting a hearing device to personal preferences and needs of a user of the hearing device, in particular when getting accustomed to using a hearing device.

BACKGROUND OF THE INVENTION

In the context of the present invention the term "hearing device" refers to hearing aids (alternatively called hearing instruments or hearing prostheses), including bone-anchored hearing aids (BAHAs), as well as to hearing implants, such as cochlear implants (CI) or direct acoustic cochlear implants (DACI), for improving the hearing capability of hearing impaired persons. Such hearing devices are able to process a received input sound signal and then provide the processed sound signal to the user, e.g. into his ear canal or to simulate the cochlear. The processing is for instance automatically adapted to the prevailing listening situation. Furthermore, the hearing device is adapted according to the individual preferences and needs of the user, for instance in dependence of the user's specific hearing deficiency, e.g. hearing loss. The process of adjusting hearing device settings, such as hearing programs, for a specific user is commonly referred to as fitting and is usually performed by a trained fitter such as a hearing device or hearing health care professional, e.g. an audiologist or a hearing device dispenser, at his office. Typically, the hearing device settings are adjusted with the aim of providing optimal speech intelligibility to the user. However, very often these settings will initially cause discomfort to the user, because most users with a hearing loss are very sensitive to increased output levels, and therefore feel overwhelmed by the amplified sound provided by the hearing device. They need to get used to hearing again in a process known as acclimatization. In order to address this problem DE 195 42 961 C1 proposes to change the hearing device settings over a predetermined time period from predetermined starting values, which are specifically chosen to be pleasant for the user, to predetermined target/end values, which are considered by the audiologist to be optimal for dealing with the user's hearing impairment. This in particular eases for fresh users of hearing devices the transition from not using a hearing device, i.e. without hearing assistance, to using a hearing device, i.e. with hearing assistance, and allows them to gradually become accustomed to the corrected level of hearing. Nevertheless, this solution is frequently not satisfactory when the starting and/or end values are not well chosen by the fitter. This can result in the user not perceiving a sufficient benefit from using the hearing device at the beginning, when the fitter is overly cautious in preventing discomfort to the user due to high output levels when starting out with using the hearing device. On the other hand, when the fitter does not take sufficient care to avoid discomfort and seeks to immediately achieve a higher hearing benefit, the user will likely be overwhelmed, and as a result thereof oppose to further using the hearing device.

Hence, there is a need for improved techniques and means for initially adapting the settings of a hearing device to a user's requirements and preferences, which both avoid discomfort when starting with using a hearing device and are able to quickly provide the user with a sufficient benefit of increased hearing perception.

SUMMARY OF THE INVENTION

It is an object of the present invention to provide an improved method for adjusting a hearing device to personal preferences and needs of a user of the hearing device in order to get the user better accustomed to the hearing device and in particular to achieve greater acceptance of the hearing device by the user. This object is reached by the method according to claim 1.

Moreover, it is a further goal of the present invention to provide an improved system for adjusting a hearing device to the personal preferences and needs of a user. This aim is achieved by the system according to claim 10.

Specific embodiments of the method and system according to the present invention are given in the dependent claims.

The present invention provides a method for adjusting a hearing device to personal preferences and needs of a user of the hearing device, comprising the steps of:

- providing one or more initial settings for one or more signal processing parameters of the hearing device;
- providing one or more target settings for the one or more signal processing parameters of the hearing device;
- providing a user control element to adjust one or more current settings of the one or more signal processing parameters;
- the user operating the user control element to provide an input for adjusting the one or more current settings so as to meet the personal preferences and needs of the user;
- adjusting the one or more current settings based on the one or more initial settings and the one or more target settings in dependence of the input to provide one or more adjusted settings for the one or more signal processing parameters.

Using this method a fitter is able to provide initial settings for the signal processing parameters of the hearing device, e.g. ones that result in a comfortable perception when the user is initially employing the hearing device, for instance based on the user's specific loudness sensitivity threshold, as well as target settings, which for instance provide optimal hearing perception to the user dependent on the user's specific hearing impairment. Moreover, the user is able to adjust the current settings by means of a user control element to better meet his personal preferences and needs, whereby the adjusted settings are dependent on the user's input as well as the initial and target settings. Through this "collaborative fitting" method (i.e. with input from both the fitter and the user), where the user is able to change the settings, e.g. to lie between the initial settings and the target settings provided by the fitter, the user can adapt the hearing device to provide both good hearing comfort and good hearing perception at any time according to his individual preferences, thus optimising the acclimatization process, e.g. speeding it up or slowing it down dependent on the user's own likes.

In an embodiment of the method the adjusting comprises interpolating between the one or more initial settings and the one or more target settings in dependence of the input, and wherein the one or more adjusted settings are based on the resulting interpolated settings.

In this way the user can choose desired settings which are located in between the initial settings and the target settings.

For instance, when the user starts employing the hearing device and feels comfortable with the loudness level but is not satisfied with speech intelligibility, he can adjust the current settings, which are at or close to the initial settings, towards the target settings, where speech intelligibility should be better, but also the loudness level will be higher and therefore likely less comfortable. The user might choose to use these adjusted settings only temporarily and take into account that the loudness level is unpleasant, so that he can profit from the increased speech intelligibility in situations when this is really important. Then when the loudness level is considered to be too unpleasant, the previously used settings, which are closer to the initial settings may be restored.

In a further embodiment of the method the adjusting comprises weighting the one or more initial settings and the one or more target settings in dependence of the input, and wherein the one or more adjusted settings are based on the resulting weighted settings, in particular on a sum of the weighted one or more initial settings and the weighted one or more target settings.

In a further embodiment of the method the weighting comprises applying one or more first weights to the one or more initial settings and applying one or more second weights to the one or more target settings, wherein an increase of the input results in a decrease of the one or more first weights and in an increase of the one or more second weights, or alternatively in an increase of the one or more first weights and in a decrease of the one or more second weights.

In a further embodiment of the method the adjusting is dependent on an amount of time that the user has been using the hearing device, in particular wherein the weighting is dependent on said amount of time. In this way the user can for instance initially, when he has recently started using the hearing device, i.e. when he has been using the hearing device for only a small amount of time, e.g. less than a week or a month, be limited to making only small adjustments of the current settings, e.g. towards the target settings. This is to avoid the user from exposing himself to high loudness levels prematurely, which could result in the user being overwhelm and subsequently ceasing to employ the hearing device. Conversely, the longer the user has been employing the hearing device, the more used to high loudness levels he becomes, so he will be allowed to make bigger adjustments without immediately feeling uncomfortable and abandoning use of the hearing device. Alternatively or additionally, when the user has been employing the hearing device for some time, he may be limited to making only small adjustments of the settings towards the initial settings, because despite the adjusted settings potentially being slightly more comfortable, they will reduce speech intelligibility and therefore possibly cause the user to give up employing the hearing device, since he feels that the benefit is too small. With the proposed method it is possible to guide the user towards the target settings where the hearing device provides optimal benefit in an expedient manner. On the other hand the user maintains a high level of control over the acclimatization process.

In a further embodiment the method comprises selecting the one or more initial settings to provide maximum spontaneous acceptance to the user. The fitter will try to determine initial settings with which the user can immediately hear better whilst feeling comfortable in terms of loudness level when he starts employing the hearing device. In this way the user will immediately be happy or at least content with the hearing device and be motivated to continue employing it.

In a further embodiment the method comprises selecting the one or more initial settings based on one or more settings of another hearing device previously used by the user. When the user has previously been employing another hearing device, he is already accustomed to experiencing higher loudness levels. Therefore, the initial settings for the new hearing device may be chosen such by the fitter that they are closer to the target settings, without the user feeling uncomfortable when he starts using the new hearing device.

In a further embodiment the method comprises selecting the one or more target settings to provide maximum discriminability and/or dissimilarity to the user, the selecting in particular being based on discrimination measurements conducted with the user. Such measurements which are performed by the fitter prior to the user starting to employ the hearing device, guarantee that when after a (presumably prolonged) period of use of the hearing device, when the settings of the hearing device have been adjusted to the target settings, the hearing device will provide optimal (maximal) benefit to the user, e.g. in terms of speech intelligibility.

In a further embodiment of the method the one or more current settings are gradually changed dependent on a usage time of the hearing device from the one or more initial settings to the one or more target settings at a certain (predefined) rate of change through intermediate settings each associated with a certain usage time, wherein at least one of the following is adjustable by means of the user control element:

- the rate of change;
- the usage time;
- the intermediate settings associated with a certain usage time, wherein the one or more current settings are then gradually changed starting from the certain usage time over the usage time from the selected intermediate settings to the one or more target settings.

By adjusting the rate of change the user can increase or decrease the speed at which the current settings evolve from the initial settings to the target settings. In this away acclimatization is accelerated or slowed down, i.e. the target settings are reached more rapidly or delayed relative to the time that the fitter presumed it would take the user to get accustomed to the hearing device.

Moreover, by adjusting the usage time the user can advance or retard the usage time. For instance, after having actually employed the hearing device for only two weeks he can adjust the usage time to three weeks such that the settings corresponding to a usage time of three weeks are employed. The user would choose this option if he has rapidly become accustomed to the hearing device (i.e. faster than anticipated by the fitter) and feels very comfortable with the loudness level, but would like to benefit from increased speech intelligibility, i.e. by advancing the current hearing device settings towards the predetermined target settings so that they are reached more quickly. Conversely, after having actually employed the hearing device for already two weeks he can adjust the usage time to merely one week such that the settings corresponding to a usage time of one week are employed. The user would choose this option if he has not become well accustomed to the hearing device (i.e. slower than anticipated by the fitter) and feels rather uncomfortable with the loudness level. Hence, by reversing the current hearing device settings back towards the predetermined initial settings the loudness level is reduced and less strenuous at the cost of reaching optimal (e.g. maximal) speech intelligibility less quickly. Additionally or alternatively, by adjusting the intermediate settings associated with a certain usage time, for instance an increased level of speech intelligibility can temporarily be achieved without advancing or retarding the usage time, such that the time originally planned is maintained, i.e. the amount of time foreseen/anticipated by the fitter to automatically adapt the hearing device settings from the initial settings to the target settings remains unchanged. In this way the user can either achieve temporary relief from high loudness levels, e.g. by replacing the current settings with settings that are closer to the initial settings, or conversely the user can temporarily improve speech intelligibility, whilst accepting a higher loudness level, for a limited period of time, e.g. by replacing the current settings with settings that are closer to the target settings. It is to be noted that the "usage time" is the time originally planned or anticipated by the user and does not have to be identical with the actual time the user has been employing the hearing device, which is apparent from the possibility that the user can adjust the usage time.

In a further embodiment of the method the user control element is located on the hearing device or additionally or alternatively on a hearing device accessory such as a remote control unit, a personal digital assistant or a smartphone.

All this allows the user to proactively influence the acclimatization process according to his individual preferences, and to comfortably achieve optimal hearing performance with the hearing device as quickly as possible for each specific user. Therefore, the time it takes will be individual for each user. In this way "self-paced" acclimatization is achieved.

Furthermore, the present invention is directed to a system for adjusting a hearing device to personal preferences and needs of a user of the hearing device, comprising:

- the hearing device with an input transducer for receiving an input sound signal, an audio signal processing unit adapted to process the input sound signal dependent on current settings for one or more signal processing parameters, and an output transducer for providing the processed sound signal to the user;
- a user control element operable by the user and adapted to provide an input for adjusting the current settings of the one or more signal processing parameters;
- a memory unit adapted to store one or more initial settings for the one or more signal processing parameters and one or more target settings for the one or more signal processing parameters;
- a controller adapted and configured to adjust the one or more current settings based on the one or more initial settings and the one or more target settings in dependence of the input to provide one or more adjusted settings for the one or more signal processing parameters.

In an embodiment of the system the controller is further adapted to perform the method according to any one of or combinations of the embodiments mentioned above.

In a further embodiment of the system the user control element is one or more of a wheel, rocker, up/down buttons, slider, touch sensitive element, a motion sensor, a proximity sensor, a light sensor and a voice control unit.

In a further embodiment of the system the user control element is located on the hearing device.

In a further embodiment the system further comprises a hearing device accessory such as a remote control unit, a personal digital assistant, a smartphone or a tablet, wherein the user control element is located on the hearing device accessory.

In this way the user can readily and easily interact with the hearing device at any time to provide an input, for instance by means of manually operating a physical button, switch, rocker, slider or wheel at the hearing device, by tapping, touching, stroking, approaching or withdrawing movements of a finger and hand at the hearing device, or via touch gestures, such as sliding, tapping or pinching on a touch sensitive screen, e.g. of a smartphone or tablet. To further facilitate the provision of a user input, the hearing device or hearing device accessory, e.g. smartphone or tablet, may be equipped with a voice control means capable of distinguishing between a plurality of voice commands spoken by the user, thus making the interaction entirely touch-/handsfree and thus even more convenient.

In a further embodiment of the system the hearing device is a hearing aid/instrument/prosthesis, in particular worn at the ear or at least partly within the ear canal of the user, a bone-anchored hearing aid (BAHA) or a hearing implant, such as a cochlear implant (CI) or direct acoustic cochlear stimulator middle ear implant (DACI), intended for users having a hearing deficiency.

In a further embodiment of the system comprising the hearing device accessory, the hearing device accessory is adapted and configured to execute a mobile application, wherein the mobile application provides:

- a graphical user interface comprising the user control element; and
- one or more functions of the controller.

It is specifically pointed out that combinations of the embodiments described above can result in even further, more specific embodiments.

BRIEF DESCRIPTION OF THE DRAWINGS

The present invention is further explained below by means of non-limiting specific embodiments and with reference to the accompanying drawings, which show the following.

DETAILED DESCRIPTION OF THE INVENTION

Figure 1:
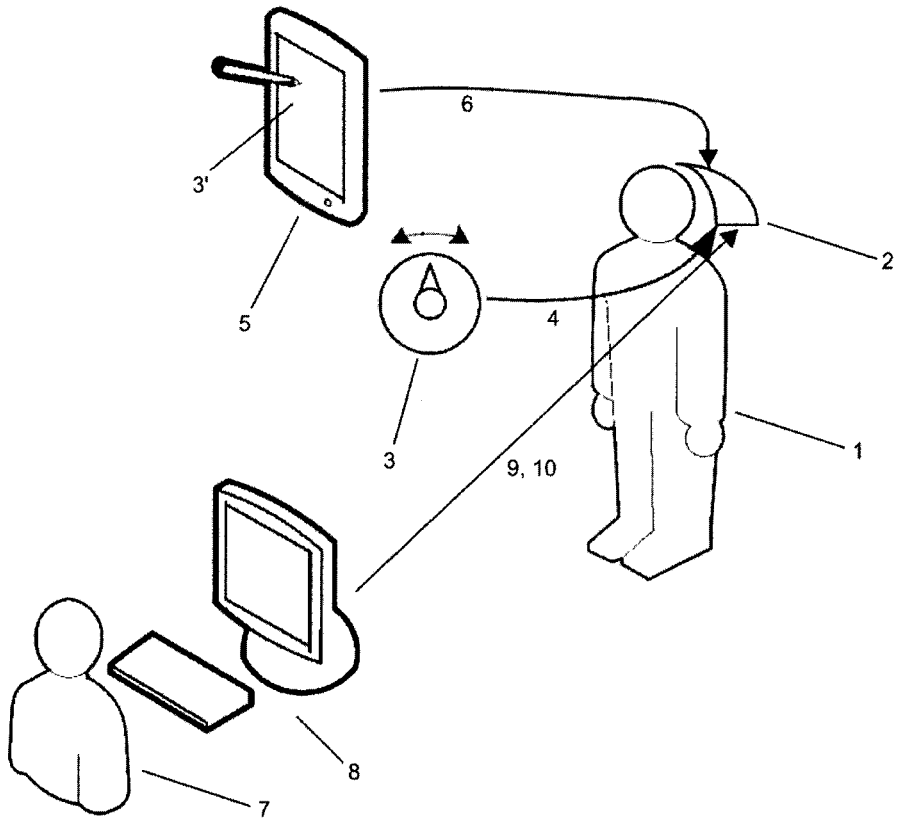
FIG. 1 depicts a conceptual diagram of a user interacting with his hearing device by means of a user control element located at the hearing device and/or a hearing device accessory such as a smartphone or tablet to adjust the settings of the hearing device during acclimatization to his personal preferences according to the method and system of the present invention.

FIG. 1 depicts in a conceptual diagram how a hearing device 2 of a user 1 is initially fitted to the personal preferences and needs of the user 1. Based on information regarding the hearing deficiency of the user 1 and the prior experience of the user 1 with using a hearing device a fitter 7 determines initial settings 9 and target settings 10 for the signal processing parameters of the hearing device 2 of the user 1. The fitter 7 further determines how the initial settings 9 are to be automatically adjusted by the hearing device 2 such that they are gradually adapted towards the target settings 10.

Determination and fitting of the initial settings 9 for the user 1 can be done as follows. For the fitting procedure a set of audio examples is available. Each audio example is for tuning of a different part, e.g. hearing program, of the hearing device's processing behaviour. The user 1 works through a set of audio examples. With each audio example the user 1 explores a multitude of different settings of the respective part of processing behaviour and searches the one which provides maximum spontaneous acceptance. This can also be referred to as a "sound parcours". Such a subjective psychoacoustic measurement can be used for both first-time and follow-up, i.e. experienced users.

For first-time users the initial settings may be set such that the hearing device 2 appears to be "acoustically transparent", thus achieving an audio perception alike to the open ear, i.e. the hearing device 2 is adjusted such that the user 1 perceives a sound the same way as if he were not wearing the hearing device 2. Preferably this requires performing a "real-ear measurement" (REM) measurement, in particular a real-ear to coupler difference (RECD) measurement. For follow-up or experienced users the settings may be chosen to be similar to the ones of the previously used hearing device. The settings of a previous hearing device may be obtained from a fitting database or by acoustically measuring the previous hearing device.

Determination and fitting of target (i.e. long-term or final) settings 10 for the user 1 can be done as follows. The user 1 works through a set of audio examples which contain pairs of similar acoustic stimuli, thus performing a discrimination measurement. With each audio example the user 1 explores a multitude of different settings of the respective part of processing behaviour and searches the one which provides maximum dissimilarity and/or discriminability of the stimuli of the audio example. Such a measurement may for instance be similar to the one employed in the known "Phonak phoneme perception test". Some settings might require a long acclimatization phase (weeks to months) because the brain needs to learn to make sense out of new peripheral cues. One example is adjusting the frequency allocation table for cochlear implant users. In this case, special discrimination tests must be applied which do not require central auditory processing capabilities. Such tests will use artificial signals like spectro-temporal ripple stimuli. Moreover, tests of individual capabilities to process temporal fine-structure (TFS) cues might be applied to better determine the optimum long-term settings. For instance, when TFS cannot be used, a place pitch-matched frequency allocation table is not necessary and it is more important to enhance envelope fluctuations in low frequencies. Alternatively, the target/long-term settings 10 may be set based on the audiogram and a fitting formula.

Figure 2:
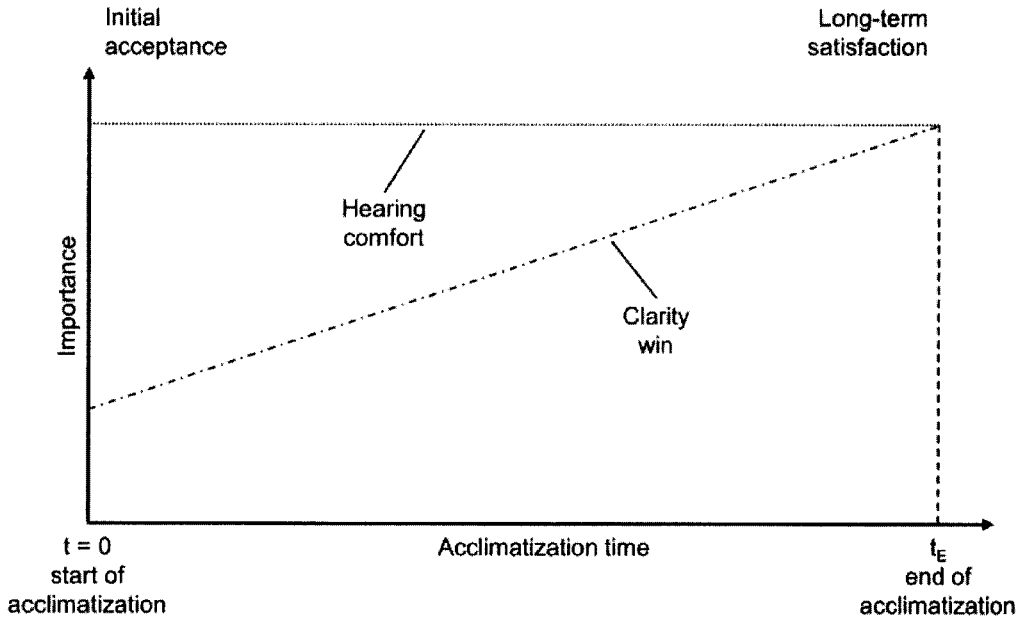
FIG. 2 graphically illustrates the importance of hearing comfort and clarity win for the user during the acclimatization process.

As indicated in FIG. 2 it is important that when the user 1 starts using the hearing device 2 that a high degree of initial acceptance is achieved. To meet his requirement the hearing device settings must be chosen to provide good hearing comfort. This is for instance the case when the loudness level of the hearing device 2 mostly remains below the user's loudness sensitively threshold, e.g. preferably 80% of the time, more preferably 90% of the time. Later, at the end of the acclimatization process, when the user 1 has become accustomed to using the hearing device 2 (i.e. in the long-term) he will only be satisfied with the hearing device 2 if an increased clarity of the perceived sound, especially improved speech intelligibility is consistently provided by the hearing device 2. This is for instance the case when hearing device settings are optimised for clarity or speech intelligibility.

Unfortunately, the two stated hearing targets, namely hearing comfort and clarity are in strong opposition for most hearing impaired users, i.e. hearing device settings suitable to achieve hearing comfort will usually not result in the desired or needed clarity, and vice-versa. Hence, the fitter 7 will determine initial settings 9 which provide just enough hearing comfort to the user 1 along with some improved clarity that the user 1 is satisfied with the hearing device 2 when he starts out using it, and preferably the hearing device 2 will be spontaneously accepted by the user 1. If however, initial settings 9 do not provide a good balance of hearing comfort and clarity win/improvement, the user 1 will very likely reject the hearing device 2 and not further use it.

Figure 3:
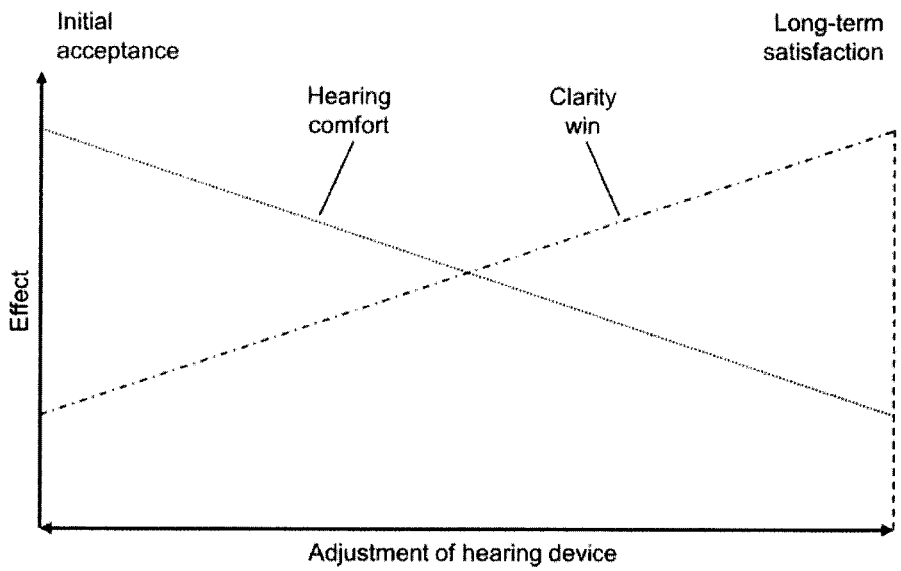
FIG. 3 graphically illustrates the trade-off between hearing comfort and clarity win at the beginning of the acclimatization process.

The trade-off between hearing comfort and clarity win is graphically illustrated in FIG. 3 for users starting out with using a hearing device 2, i.e. at the beginning of the acclimatization process. The optimal trade-off for most users will lie in the left third of the graph, where hearing comfort clearly dominates over clarity win.

Figure 4:
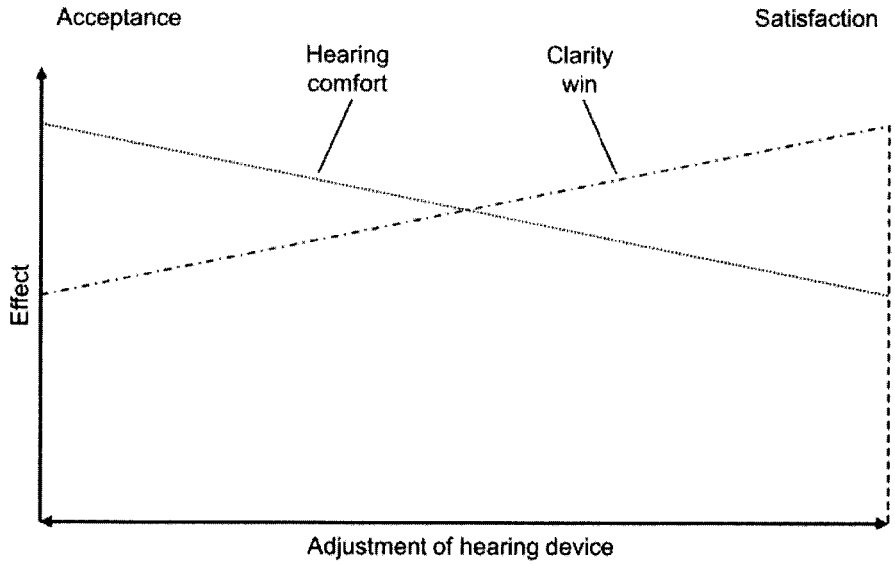
FIG. 4 graphically illustrates the trade-off between hearing comfort and clarity win at the end of the acclimatization process.

At the end of the acclimatization process when the user 1 has become very accustomed to using the hearing device 2 the trade-off graph will look substantially different, an example of which is illustrated in FIG. 4. The optimal trade-off for most users will then lie in the right third of the graph, where clarity win clearly dominates over hearing comfort.

The present invention allows the user 1 to be involved in making this trade-off of hearing comfort versus clarity/speech intelligibility at any time during the acclimatization process.

From what was stated above it is apparent that depending of the user's level of experience with using a hearing device 2, i.e. how far along he is in the acclimatization process clarity and speech intelligibility will become increasingly important and hearing comfort will gradually be less of an issue. Therefore, apart from providing initial and target hearing device settings 9, 10, the fitter 7 will also provide a timing setting which tells the hearing device 2 how to automatically perform acclimatization by gradually adjusting current settings of the hearing device 2 from the initial settings 9 towards the target settings 10 over time. This process can be regarded as "fading" or "morphing" the hearing device settings from the initial settings 9 to the target/final/long-term settings 10.

The process of "morphing" of the hearing device settings can for instance be done as follows. From the initial settings 9 and the target settings 10 a "macro-parameter" (i.e. comprising one or more signal processing parameters) is calculated which interpolates both settings with selectable weightings of initial and target settings 9, 10. The user 1 uses this macro-parameter for adjusting the hearing device's settings on a daily basis or even multiple times per day when in different hearing situations as far as needed. Strong weighting of the initial settings 9 gives more familiarity and less distinction—at least at the beginning of the acclimatization process. Strong weighting of the target settings 10 gives more distinction where hearing is less familiar—at least at the beginning of the acclimatization process. Later settings which are nearer to the target settings 10 become more and more familiar, this the more the more the user 1 tries out respective settings. This happens because the user 1 experiences that settings nearer to the target settings 10 provide more clarity due to improved distinction.

An "acclimatization management" may be implementing to control this procedure. An important aspect is that the macro-parameter comprises a multitude of fitting parameters (not only volume), such as e.g. a compression ratio and knee-point, channel gains and frequency compression in the hearing aid, and comfort and threshold levels (M/T), input dynamic range (IDR) and frequency allocation table in the cochlear implant (CI). For bimodal patients (i.e. with a CI on one side and a hearing aid on the other) and EAS patients (i.e. both a hearing aid and a CI on one side providing electrical as well as acoustical stimulation at the same time) the macro-parameter has to control underlying fitting parameters in a perceptually equivalent and aligned manner, i.e. adjust channel gains in the hearing aid and M/T-levels for the CI to achieve the same loudness change or increasing acoustic bandwidth to compensate for a change in the electric frequency allocation table.

Looking back at FIG. 1, the initial and target settings 9, 10 determined by the fitter 7 with the aid of fitting software executed by the fitting system 8 are transfer from the fitting system 8 to the hearing device 2. When employing the hearing device 2 the user 1 may adjust the currently employed hearing device settings by operating a user control element 3, e.g. located at hearing device 2, to provide an input 4. Alternatively, the user 1 may provide an input 6 for adjusting the currently employed hearing device settings by means of a hearing device accessory 5 such as a remote control unit or personal digital assistant, in particular a smartphone or tablet executing an mobile app(lication) adapted to interact with the user 1, e.g. via a touchscreen. The hearing device accessory 5 is operationally connected to the hearing device 2 for instance wirelessly via Bluetooth or inductive link. The mentioned macro-parameter can then be adjusted by the user 1 to provide an appropriate input 4, 6 to the hearing device 2.

Figure 5:
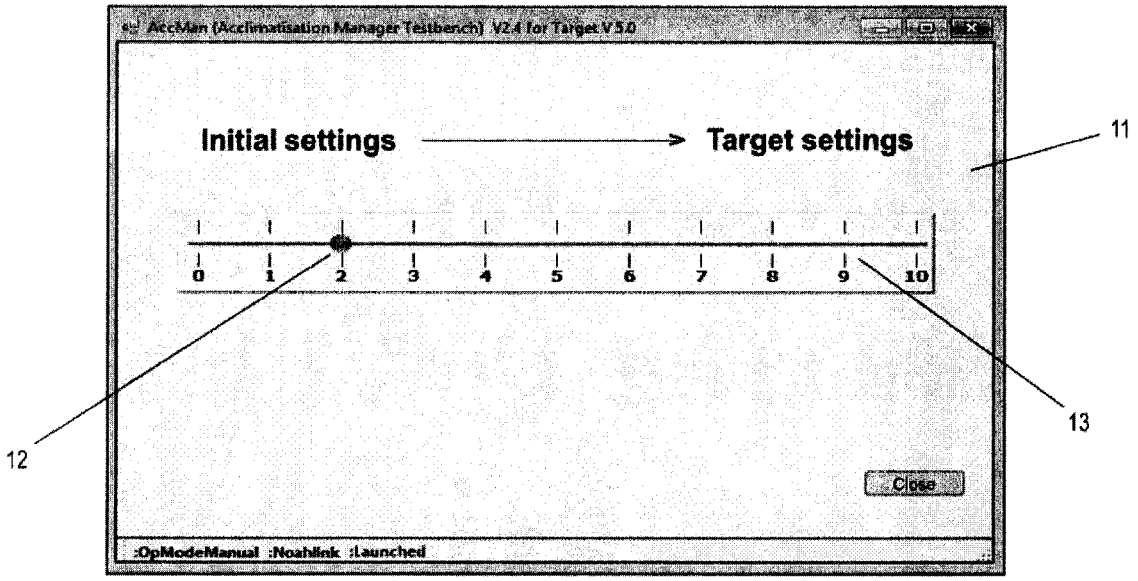
FIG. 5 depicts an exemplary screenshot of a self-paced acclimatization prototype according to the present invention running on the smartphone/tablet shown in FIG. 1.

FIG. 5 depicts an exemplary screenshot of a self-paced acclimatization prototype according to the present invention running on the smartphone/tablet 5 shown in FIG. 1. The graphical user interface (GUI) 11 of the mobile app comprises a slider 12, which allows the user 1 to adjust the macro-parameter such that the current settings are adapted either more towards the initial settings 9 by shifting the slider 12 to the left or more towards the target settings 10 by shifting the slider 12 in the opposite direction towards the right along the adjustment scale 13 between a value of 0 (corresponding to the initial settings 9) to 10 (corresponding to the target settings 10).

Figure 6:
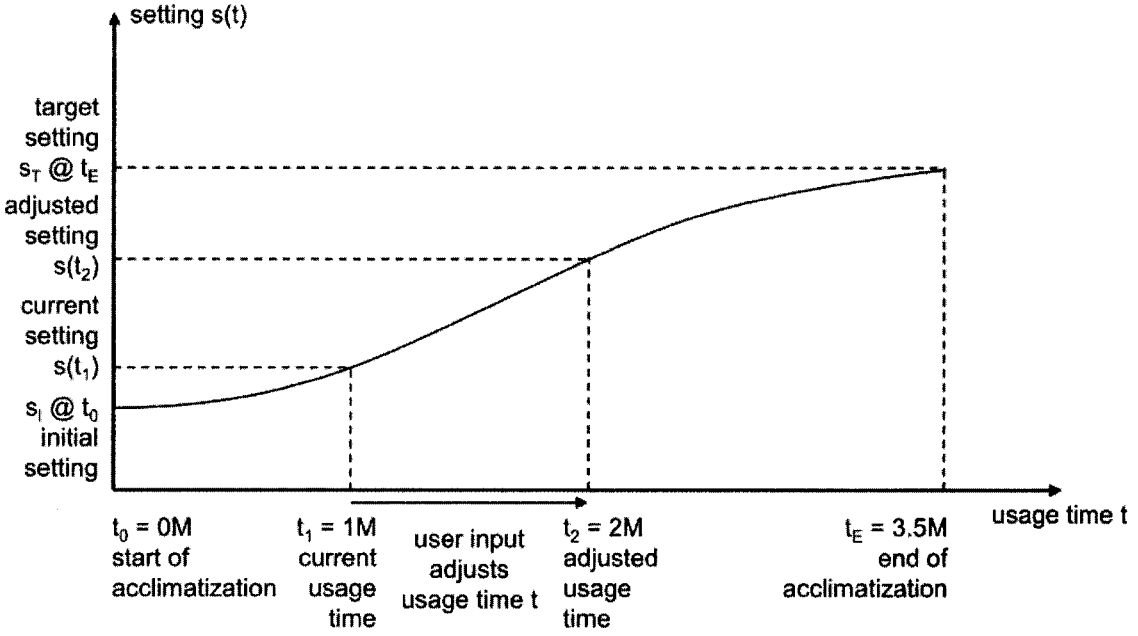
FIG. 6 graphically illustrates the user input adjusting a hearing device setting (e.g. volume) towards improved speech intelligibility by advancing the usage time.

FIG. 6 graphically illustrates an exemplary adjustment of the hearing device settings by the user 1 towards improved speech intelligibility by advancing the usage time t. The fitter 7 will determine a time progression of the settings suitable for the user 1, e.g. of the volume/loudness, starting with an initial setting $s_I$ at time t=0 that is gradually adapted over time towards a target setting $s_T$ at time $t=t_E$, i.e. when the acclimatization process is complete. As is apparent from the graph shown in FIG. 6 the volume only increases very slightly (i.e. the rate of change of the volume is slow) when the user 1 starts out with using the hearing device 2, then increases in the middle of the acclimatization process and tapers off again (i.e. becomes slower) towards the end of the acclimatization process. The user 1 is able to influence the acclimatization process by for instance speeding it up or slowing it down by means of the input 4, 6 he provides via the user control element 3, 3' either on the hearing device 2 itself or the hearing device accessory 5, e.g. via touch gesture, such as sliding, tapping or pinching (to zoom). In the example shown in FIG. 6 the user 1 advances the usage time t from the current usage time $t_1$ to the adjusted usage time $t_2$, because the user 1 wants to speed up the acclimatization process. This results in a higher volume setting (i.e. one closer to the target volume setting) being applied earlier on in the acclimatization process than was foreseen by the fitter 7. In this way the user 1 is able to set the pace of the acclimatization process according to his personal preferences, thus improving his acceptance of the hearing device 2, i.e. increasing his satisfaction with the performance provided by the hearing device 2.

The present invention makes use of a form of "collaborative fitting", where both the fitter 7 as well as the user 1 each provide input to adjust the settings of the hearing device 2. Collaborative fitting is a compromise between "self-fitting" by the user 1 and fitting by a professional, i.e. a trained fitter 7. Collaborative fitting keeps the fitter 7 in the loop while making use of the benefits which come with self-fitting. The method and system according to the present invention especially gives more control to the user 1, allowing self-paced acclimatization, which results in a higher degree of acceptance of the hearing device 2 by the user 1.

The invention claimed is:

1. A method for adjusting a hearing device to personal preferences and needs of a user of the hearing device, comprising the steps of:

providing an initial setting and a target setting for one or more signal processing parameters of the hearing device, the initial setting associated with a start time of an acclimatization time period and the target setting associated with an end time of the acclimatization time period;

performing an acclimatization process in which a current setting for the one or more signal processing parameters is gradually adjusted from the initial setting to the target setting, the current setting associated with a current usage time within the acclimatization time period;

detecting user input, provided by a user by way of a user control element during the acclimatization process, that adjusts the current usage time to an adjusted usage time within the acclimatization time period; and updating, based on the user input, the acclimatization process to gradually adjust the current setting from the adjusted setting to the target setting.

2. The method of claim 1, wherein the adjusting of the current setting performed as part of the acclimatization process comprises interpolating between the initial setting and the target setting in dependence of the user input, and wherein the adjusted setting is based on the interpolating.

3. The method of claim 1, wherein the adjusting of the current setting performed as part of the acclimatization process comprises weighting the initial setting and the target setting in dependence of the user input, and wherein the adjusted setting is based on the resulting weighted settings.

4. The method of claim 3, wherein the weighting comprises applying one or more first weights to the initial setting and applying one or more second weights to the target setting, wherein an increase of the user input results in a decrease of the one or more first weights and in an increase of the one or more second weights, or alternatively in an increase of the one or more first weights and in a decrease of the one or more second weights.

5. The method of claim 1, wherein the adjusting of the current setting performed as part of the acclimatization process is dependent on an amount of time that the user has been using the hearing device.

6. The method of claim 1, comprising selecting the initial setting to provide maximum spontaneous acceptance to the user.

7. The method of claim 1, comprising selecting the initial setting based on one or more settings of another hearing device previously used by the user.

8. The method of claim 1, comprising selecting the target setting to provide maximum discriminability to the user.

9. The method of claim 1, wherein the gradual adjustment of the current setting is performed at a predefined rate of change.

10. The method of claim 9, further comprising:

detecting additional user input comprising a request to adjust the predefined rate of change; and adjusting, based on the additional user input, the predefined rate of change.

11. The method of claim 1, wherein the user input adjusts the current usage time to a usage time that precedes the current usage time.

12. The method of claim 1, wherein the user input adjusts the current usage time to a usage time that is subsequent to the current usage time.

13. A system for adjusting a hearing device to personal preferences and needs of a user of the hearing device, comprising:

the hearing device with an input transducer for receiving an input sound signal, an audio signal processing unit adapted to process the input sound signal dependent on a current setting for one or more signal processing parameters, and an output transducer for providing the processed sound signal to the user;

a user control element operable by the user;

a memory unit adapted to store an initial settings for the one or more signal processing parameters and a target setting for the one or more signal processing parameters, the initial setting associated with a start time of an acclimatization time period and the target setting associated with an end time of the acclimatization time period;

a controller adapted and to:

perform an acclimatization process in which the current setting is gradually adjusted from the initial setting to the target setting, the current setting associated with a current usage time within the acclimatization time period;

detect user input, provided by the user by way of the user control element during the acclimatization process, that adjusts the current usage time to an adjusted usage time within the acclimatization time period; and update, based on the user input, the acclimatization process to gradually adjust the current setting from the adjusted setting to the target setting.

14. The system of claim 13, wherein the controller is further adapted to perform the adjusting of the current setting as part of the acclimatization process by interpolating between the initial setting and the target setting in dependence of the user input.

15. The system of claim 13, wherein the user control element is one or more of a wheel, a rocker, up/down buttons, a slider, a touch sensitive element, a motion sensor, a proximity sensor, a light sensor or a voice command unit.

16. The system of claim 13, wherein the user control element is located on the hearing device.

17. The system of claim 13, further comprising a hearing device accessory, wherein the user control element is located on the hearing device accessory.

18. The system of claim 13, wherein the hearing device is a hearing aid or a hearing implant.

* * * * *